United States Patent [19]

Stoddart

[11] Patent Number: 4,531,312

[45] Date of Patent: Jul. 30, 1985

[54] BAGGAGE CLAIM TICKET HOLDER

[75] Inventor: Raymond Stoddart, Middle Village, N.Y.

[73] Assignee: Edward L. Gilkey, Maspeth, N.Y.

[21] Appl. No.: 271,474

[22] Filed: Jun. 8, 1981

[51] Int. Cl.[3] ..... G09F 3/18

[52] U.S. Cl. ..... 40/10 D; 40/16; 40/17

[58] Field of Search ..... 40/16 R, 17 R, 486; 283/6

[56] References Cited

U.S. PATENT DOCUMENTS

| | | | |
|---|---|---|---|
| 812,633 | 2/1906 | Bradham | 40/17 |
| 2,297,285 | 9/1942 | Bledsoe | 40/2 A |
| 2,535,265 | 12/1950 | Caffrey | 40/17 X |
| 2,629,952 | 3/1953 | Gazan | 40/17 |
| 2,898,257 | 8/1959 | Carver | 40/16 X |
| 2,925,675 | 2/1960 | Lumpkin | 40/10 D |
| 3,228,128 | 1/1966 | Sharp | 40/486 |
| 4,333,253 | 6/1982 | Cooper | 40/10 R |

*Primary Examiner*—Gene Mancene
*Assistant Examiner*—Wenceslao J. Contreras
*Attorney, Agent, or Firm*—Howard I. Podell

[57] ABSTRACT

A baggage tag retainer adaptable to be permanently bonded to the exterior of a luggage container. The retainer is shaped so as to detachably retain a conventional airline destination baggage claim tag and is marked with a permanent identification number that is concealed from view when the airline baggage tag is mounted in the retainer. By means of my invention, baggage destination tags will be more securely fixed to luggage so as to prevent loss of the tag during the normal handling of the luggage on conveyor systems and the luggage will be permanently identified with the owner, while all such owner identification is concealed from view of unauthorized persons during transport of the luggage.

1 Claim, 8 Drawing Figures

FIG. 1
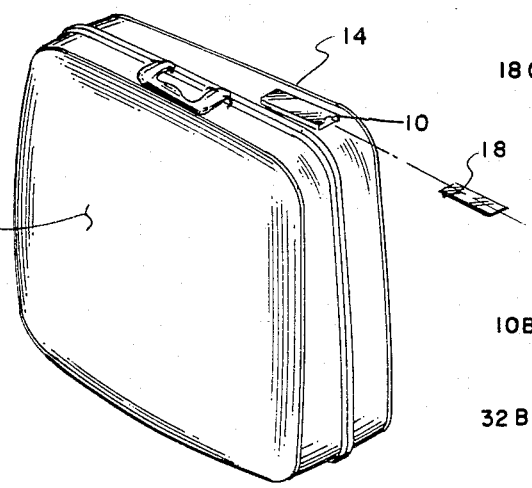
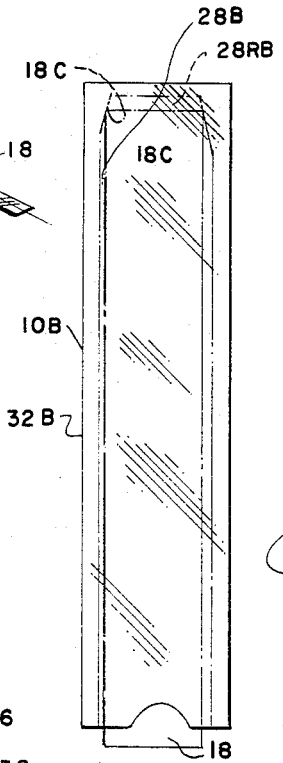
FIG. 6
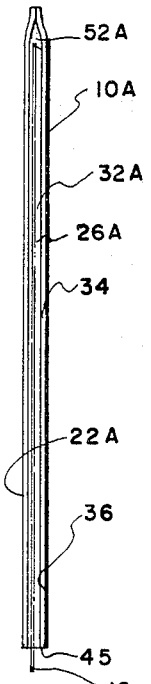
FIG. 4
FIG. 8
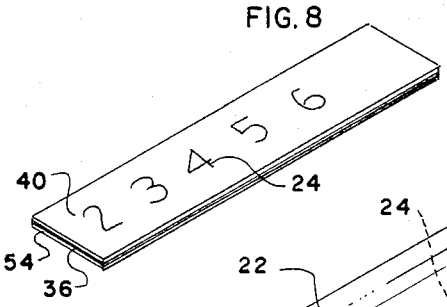
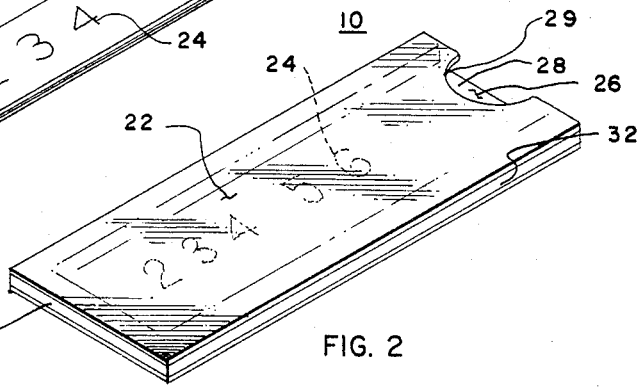
FIG. 2
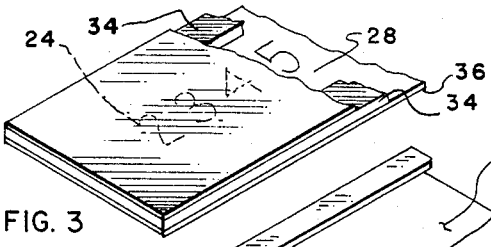
FIG. 3
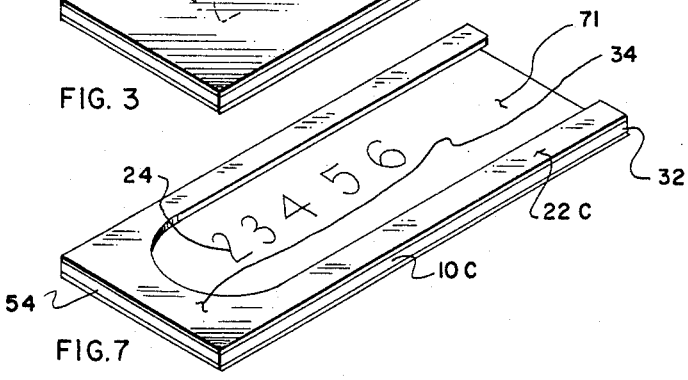
FIG. 7
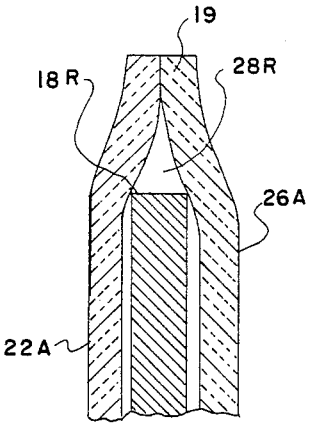
FIG. 5

BAGGAGE CLAIM TICKET HOLDER

BACKGROUND OF THE INVENTION

The proper identification of the destination and the owner of luggage presents many problems to travellers and to hotel and transport company employees. Identification tags that are fastened with strings are readily torn off in normal handling. On the other hand tags permanently fixed to luggage that identifies the home address of the owner presents a security problem since such a tag serves as a public notice that the owner is far away from his home, and that his home may be therefore unguarded against burglary.

The following is a list of previous U.S. patents in the field of the invention which deal with the problem of luggage identification: U.S. Pat. Nos. 2,812,601; 652,499; 989,297; 3,335,509; 554,171; 3,727,333; 1,831,854; 2,181,796; 1,767,573; 2,793,451; 2,811,797; 1,714,421; and 1,797,114.

However, none of these inventions provide the full security to the user of my invention, as hereinafter recited.

SUMMARY OF THE INVENTION

My invention is a baggage tag retainer adaptable to be permanently bonded to the exterior of a luggage container. The retainer is shaped so as to detachably retain a conventional airline destination baggage claim tag and is marked with a permanent identification number that is concealed from view when the airline baggage tag is mounted in the retainer. By means of my invention, baggage destination tags will be more securely fixed to luggage so as to prevent loss of the tag during the normal handling of the luggage on conveyor systems and the luggage will be permanently identified with the owner, while all such owner identification is concealed from view of unauthorized persons during transport of the luggage.

In particular, my invention comprises a shaped one-piece holder that is permanently bonded to the exterior of a piece of luggage, together with an auxiliary tag that is adjustable for fastening to the interior of the luggage container. Both the tag and the holder are permanently marked or embossed with a particular identification number. The identification number may be assigned to the owner of the luggage by a travel security organization that may also furnish the tag and holder. This security service organization can maintain records of the permanent residence and of the current travel plans of each subscriber and may reveal such information only to authorized representatives of airlines, hotels and travel agencies when it is necessary to reroute luggage which has become delayed in transit or where the destination tag of the luggage has become lost or unreadable.

However, since the current airline destination tag, or the tag identifying the last previous trip of the luggage completely blocks view of the permanent identification number, it is not possible for an unauthorized third party to identify the traveller or residence address of the traveller who is accompanying the luggage, as is the case with use of conventional luggage identification tags and tag holders. Consequently there is no public disclosure that the traveller's residence may be unguarded and ripe for burglary.

Furthermore, the shape of the permanent holder of the invention securely holds the airline baggage destination tag to prevent its inadvertent separation from the luggage under normal or abnormal conditions of rough handling of the luggage, during transport, while rendering possible the removal and replacement of the airline destination baggage tag as required.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention in use;

FIG. 2 is a perspective view of the retainer unit,

FIG. 3 is a detail perspective view of the retainer unit;

FIG. 4 is a side view of a first alternative embodiment of the retainer unit;

FIG. 5 is a detailed sectional view of the first alternative embodiment;

FIG. 6 is a plan view of a second alternative embodiment of the invention;

FIG. 7 is a perspective view of a third alternative embodiment of the invention; and FIG. 8 is a perspective view of the auxiliary identification tag.

DESCRIPTION OF THE PREFERRED EMBODIMENT

Turning now descriptively to the drawings, in which similar reference characters denote similar elements throughout the several views, FIGS. 1–2 illustrate the retainer unit 10 which in use, is permanently bonded to the external surface 12 of a container of luggage 14 for detachable retention and display of an airline travel baggage ticket 18.

Retainer 10 is preferably formed of plastic material, with the upper wall 22 fabricated to transparent material so as to expose to view permanent identification indicia 24 embossed on the bottom wall 26, when the interior chamber 28 is not occupied by the travel baggage claim ticket 18, and to expose to view the face of a baggage claim ticket 18 that is enclosed in the chamber 28.

Chamber 28 is bounded by the upper and lower walls 22, 26 which are separated by, and fixed to spacers 32, 54 along the sides and closed end respectively of the retainer unit. A finger notch slot 29 is shaped in the leading edge of the upper wall to assist a user in removing a baggage ticket 18 from chamber 28, when desired.

Indicia 24 may be marked or embossed on the interior surface of bottom wall 26 or alternatively marked or embossed on the exterior surface of the bottom wall, when the bottom wall is fabricated of transparent plastic material so that the indicia is visible through the transparent top wall when the retainer unit is mounted to the luggage 14, and when there is no travel baggage ticket 18 in the chamber 28 which would block the view of indicia 24.

As shown in FIG. 4, an adhesive coating 34 is bounded to the underside of the bottom wall and protected, prior to installation, by a peelable sheet 36.

An auxiliary tag 40, marked with the same indicia 24 as that of the retainer unit 10 is available for fastening to an interior surface of the luggage 14 as a means of identification in the event that the retainer unit is damaged in use.

Tag 40 is also coated with an adhesive coating 34, on its undersurface that is protected, prior to use, by a peelable strip 36. Tag 40 may be fabricated of plastic or sheet metal as desired.

Chamber 28 is of a size and shape so that some of the chamber walls frictionally engage a strandard size airline baggage ticket 18 which is conventionally marked with indicia indicating the destination airport and the individual claim number of the ticket 18.

FIG. 4 illustrates a first alternative embodiment 10A of the retainer unit, in which the chamber side walls formed by spacers 32A are spaced apart by a width substantially greater than that of a standard baggage ticket 18, with the height of spacers 32A such as to space walls 26A and 22A apart by a distance substantially greater than the thickness of baggage ticket 18 for most of the length of the retainer unit so that ticket 18 may be freely slid into or out of chamber, from the open front chamber end 45. Each spacer 32A is tapered at its rear end 52A so that the top wall 22A is inclined to approach the bottom wall 26A at the rear end 19 of the unit so as to reduce the height of chamber 28 to less than the thickness of the baggage ticket 18 in the rear end of the chamber 18 to form a frictional snug fit of the rear end 18R of the baggage ticket against the relatively inclined top and bottom wall sections at the rear section 28R of chamber 28. By this means, the ticket 18 is free of frictional clamping action by the walls of chamber 28 when it is inserted or removed, except for the frictional clamping effect against the rear end section 18R of the ticket in the fully inserted position of the ticket 18 in chamber 28, which serves to hold the fully inserted ticket in place.

FIG. 6 illustrates a second alternative embodiment 10B of the retainer, in which the side spacers 32B bounding internal chamber 28B of the holder are inclined towards each other at the rear end section 28RB of the chamber 28B, with spacers 32B spaced apart by a substantially greater distance than the width of the rectangular baggage ticket 18 for most of the length of the chamber 28B, with spacers 32B approaching each other in the rear section of the unit to a distance less than the width of the standard airline ticket 18 so as to pinch against the rear corners 18C of the fully inserted ticket 18 to hold the ticket in frictional engagement only in the substantially fully seated position, while providing for a relatively friction-free fit when the unseated ticket is removed or installed in the chamber 28B.

Top wall 22 need not be continuous across the full length or width of the retainer. If desired, a top wall 22C may be formed with a large recess 71 so that it forms a flange projecting beyond the side spacers 32 and the end spacer 54 of the retainer. In this embodiment, the device 10C may be fabricated of metal or other opaque material since an inserted baggage tag 18 or the coded indicia 24 will be visible through the recess, as shown in FIG. 7.

The retainer 10 will be a key element in the method of luggage and travel security devised by the applicant. A travel security service organization which furnished one or more of the retainer 10 to the user, all marked with a coded indicia 24, will maintain records of the individual indicia code numerals assigned each user. The user will be encouraged to advise this organization of his schedule and itinerary, when travelling so that any delayed "lost" luggage may be rerouted to a further destination of the user based on his travel schedule. Thus when an airline finds that travel luggage has been unclaimed, the airline may contact the security organization, after removing the obsolete airline baggage tag 18 and noting the permanent coded indicia 24. The security organization will be able to inform authorized agencies such as airlines and hotels of the current schedule of the traveller and enable the airline to reroute the baggage to catch up with the traveller at his hotel or at his next destination, if necessary.

Since an airline baggage tag 18 will always be retained in the unit, during travel times, the coded indicia 24 will be invisible to any unauthorized third parties who might wish to take advantage of knowlege of the traveller's identification or residence address.

Since obvious changes may be made in the specific embodiment of the invention described herein, such modifications being within the spirit and scope of the invention claimed, it is indicated that all matter container herein is intended as illustrative and not as limiting in scope.

Having thus described the invention, what I claim as new and desire to secure by Letters Patent of the United States is:

1. A method of providing for identification and travel schedule of the user of an item of travel luggage to authorized personnel, while preventing disclosure of identification to others to whom the luggage may be visible utilizing a retainer comprising: A housing formed with a top wall and a bottom wall that bound a shaped internal chamber which is open at the front end of the housing, said chamber being of a size to substantially enclose and frictionally retain a baggage claim tag of the size of the standard size destination and claim check tag employed by airlines, said housing formed with a transparent top wall fabricated so as to expose to view the exterior marked surface of a baggage claim tag enclosed in the said chamber or alternatively to expose to view the interior surface of the bottom wall of the housing together with identification located on said bottom wall of a size and shape so as to be visible to view only when said claim tag is not enclosed in said chamber, said housing being fitted with means to fasten the said housing to the exterior of an item of luggage and said method comprising the following steps;

(a) registration with a service organization by the user of the indicia marked on his retainer unit so that the indicia serves as his coded identification with said service organization;

(b) Installation of the retainer unit on the exterior of an item of travel luggage by fastening the housing of the retainer to the exterior of the said item of luggage;

(c) Registration with said service organization of a travel plan and schedule of the user of the indicia together with authorization by the user to said service organization to permit the service organization to divulge the identification and schedules of the user to personnel of airlines and hotels upon receipt from the said personnel of identification information of said indicia as required;

(d) installation by the user, or by said personnel, of an airline baggage destination and claim check in the chamber of the retainer unit so as to conceal form view the indicia.

* * * * *